US008080771B2

(12) United States Patent
Shai

(10) Patent No.: US 8,080,771 B2
(45) Date of Patent: Dec. 20, 2011

(54) STEERING SYSTEM AND METHOD FOR A GUIDED FLYING APPARATUS

(75) Inventor: Mordechai Shai, Hod-Hasharon (IL)

(73) Assignee: Israel Aerospace Industries Ltd., Lod (IL)

( * ) Notice: Subject to any disclaimer, the term of this patent is extended or adjusted under 35 U.S.C. 154(b) by 363 days.

(21) Appl. No.: 11/910,155

(22) PCT Filed: Jan. 26, 2006

(86) PCT No.: PCT/IL2006/000108
§ 371 (c)(1),
(2), (4) Date: Jun. 16, 2008

(87) PCT Pub. No.: WO2006/103647
PCT Pub. Date: Oct. 5, 2006

(65) Prior Publication Data

US 2009/0084888 A1 Apr. 2, 2009

(30) Foreign Application Priority Data

Mar. 29, 2005 (IL) ..... 167721

(51) Int. Cl.
*F42B 15/01* (2006.01)
*F42B 10/66* (2006.01)
*F42B 15/00* (2006.01)
*F42B 10/00* (2006.01)

(52) U.S. Cl. ..... 244/3.22; 244/3.1; 244/3.15; 244/3.21; 244/51; 244/52

(58) Field of Classification Search ..... 244/3.1–3.3, 244/51, 52; 89/1.11; 342/61–66, 175, 195; 102/473, 501
See application file for complete search history.

(56) References Cited

U.S. PATENT DOCUMENTS

| | | | | |
|---|---|---|---|---|
| 2,979,284 | A * | 4/1961 | Genden et al. | 244/3.14 |
| 2,989,922 | A * | 6/1961 | Greenwood et al. | 244/3.23 |
| 3,008,667 | A * | 11/1961 | Dean | 244/3.19 |
| 3,011,738 | A * | 12/1961 | Skramstad et al. | 244/3.15 |
| 3,081,049 | A * | 3/1963 | Fuchs | 244/3.14 |
| 3,094,072 | A * | 6/1963 | Parilla | 244/3.22 |
| 3,145,949 | A * | 8/1964 | Smith, Jr. | 244/3.16 |

(Continued)

FOREIGN PATENT DOCUMENTS

DE 4232748 A1 3/1994

*Primary Examiner* — Bernarr Gregory
(74) *Attorney, Agent, or Firm* — Browdy and Neimark, PLLC

(57) ABSTRACT

A steering system for use in a traveling guided flying apparatus (10) and method for driving the steering system are provided. The system includes an outer housing (111), an inner housing (113) and a support fins (112) extending inwardly from the outer housing (111) and holding the inner housing (113) thereon. The outer housing (111) and the inner housing (113) define a ram air inlet (114) at a nose of the forward portion (11), an annular inlet air passage (115), an annular pressure chamber (116), and an outlet air passage (125). The steering system further includes exhaust outlets (120) arranged in the outer housing and separately controlled valves (124) mounted at the exhaust outlets (120) configured to vary the flow of escaping air through the exhaust outlets (120). The steering system also includes a target seeker (121), one or more pressure sensors (119) mounted in the pressure chamber (116) and a control unit (122) for controlling flight of the guided projectile (10).

10 Claims, 3 Drawing Sheets

U.S. PATENT DOCUMENTS 3,208,383 A * 9/1965 Larson ..... 244/3.22
3,414,217 A * 12/1968 Kesting ..... 244/3.23
3,819,117 A 6/1974 Moorhead, Jr.
3,977,629 A 8/1976 Tubeuf
4,428,293 A * 1/1984 Botwin et al. ..... 244/3.21
4,502,649 A * 3/1985 Botwin et al. ..... 244/3.1
4,522,357 A * 6/1985 Bains et al. ..... 244/3.22
4,537,371 A 8/1985 Lawhorn et al.
4,573,648 A * 3/1986 Morenus et al. ..... 244/3.22
4,685,639 A * 8/1987 Bains ..... 244/3.22
4,726,544 A 2/1988 Unterstein
5,044,156 A 9/1991 Deffayet
5,706,650 A 1/1998 Thayer
5,853,143 A * 12/1998 Bradley et al. ..... 244/3.21
5,904,319 A * 5/1999 Hetzer ..... 244/3.24
6,369,373 B1 * 4/2002 Tepera et al. ..... 244/3.3
6,576,880 B2 * 6/2003 Martorana et al. ..... 244/3.1

* cited by examiner

STEERING SYSTEM AND METHOD FOR A GUIDED FLYING APPARATUS

FIELD OF THE INVENTION

This invention relates to the field of flying apparatus control systems, and in particular, to the area of projectile and missile steering through the use of ram air for lateral thrust control.

BACKGROUND OF THE INVENTION

Lateral steering control is an important feature in projectile guidance systems. Such control provides the ability to improve weapon accuracy and correct for initial aiming errors and target maneuvers.

Various lateral projectile control techniques are known in the art. One of such techniques is based on aerodynamic control, and include deflecting tail fins, canard lifting surfaces and other deflecting elements.

Another known technique is based on jet thrust control and include cold gas jet thrusters, warm gas jet thrusters, impulse thrusters and explosive thrusters. These systems, for example, can employ side mounted exhaust outlets coupled to sources of highly pressurized gases through adjustable control valves. In the case of self-propelled missile, such sources are usually common to the fuel source of the missile. Whilst, in the case of fired projectiles, the sources dedicated to the steering function are separately ignited by an auxiliary device.

For example, U.S. Pat. Nos. 4,726,544 and 5,044,156 describe various steering systems for the final phase of a guided projectile. The steering is achieved by control jets acted upon by hot gas created in a combustion chamber.

U.S. Pat. No. 4,573,648 teaches the use of ram air for thermodynamic ignition of a solid fuel. The steering system includes an open-ended diffusion chamber and an adjacent combustion chamber located in the nose of a projectile to receive ram air that ignites a solid fuel material within the combustion chamber. A pair of oppositely disposed lateral steering ports are provided aft of the combustion chamber and are interconnected therewith via a diverting valve that is controllable to selectively divert the escaping combustion gases from the combustion chamber to one or both of the steering ports to thereby change or maintain the trajectory course of the projectile after firing.

The systems which are dependent upon a propellant source carried onboard the missiles and/or projectiles face problems related to fuel exhaustion and shift in center of mass as fuel is used. These systems may also introduce the additional complexity associated with combustion chamber and fuel supply systems.

The use of rain air for lateral steering control instead of the gas created in a combustion chamber is also known in the art (see, for example, U.S. Pat. Nos. 4,522,357, 4,685,639 and 4,537,371).

For example, U.S. Pat. No. 4,522,357 teaches the use of ram air for steering a projectile which is fin stabilized and has a normal in-flight roll rate of about 1200 rpm. The ram air enters a nose opening in a projectile during projectile flight passes to a central chamber and is selectively diverted to laterally positioned and oppositely oriented steering jets. The steering jets are interconnected with the aft end of the central chamber. A diverting mechanism is located between the central chamber and each of the steering jets to allow either one or none of the steering jets to provide correctional steering forces when desired. The diverting mechanism includes a deflector mounted on a shaft and rotated in the opposite direction to that of the rotating projectile. In order to provide a differently directed thrust force, the deflector is rotationally driven at a different speed so that the steering thrust vector is redirected. The projectile is guided to the target via an information beam of energy radiated from a source at the firing location. The information beam contains relative location codes which are used together with vertical reference information derived from on-board roll reference sensor to correct the flight path of the projectile.

U.S. Pat. No. 4,537,371 describes a small caliber guided projectile having a forward opening inlet which provides supersonic stream ram air to a flow control mechanism prior to exhausting such air through a pair of diametrically opposed bifurcated guidance nozzles. The flow control mechanism includes a primary flow passageway and orifice switching devices for controlling bypass flow to the exhaust nozzles. Means of vortex generation is located upstream of the discharge of the flow through switching devices into the nozzles. When the switching devices are closed, flow over the means of vortex generation generates a small vortex for triggering a boundary attachment flow as a result of the Coanda effect and increases flow through the nozzle. Opening of the orifice switching device results in aspiration through the nozzle, thereby impeding flow. By controlling the respective switching devices, flow through the opposed nozzles may be varied to produce a resultant lateral force on the projectile, permitting control of the trajectory of the projectile.

SUMMARY OF THE INVENTION

Despite the prior art in the area of projectile steering through the use of rain air for lateral thrust control, there is still a need in the art for further improvement in order to provide a steering system for use in a flying apparatus, such as a projectile, missile, etc., which is not rolling or rolling around its axis, and is able to fly at subsonic and/or transonic speed.

The present invention partially eliminates disadvantages of the prior art techniques and provides a steering system for use in a traveling guided flying apparatus, the system comprising:

an outer housing and an inner housing defining: a ram air inlet at a nose of the forward portion, an annular inlet air passage, an annular pressure chamber, and outlet air passage between an inside wall of the outer housing and an outside wall of the inner housing;

a plurality of support fins extending radially inwardly from the outer housing and holding the inner housing thereon;

a plurality of exhaust outlets arranged in the outer housing;

a plurality of separately controlled valves mounted at the exhaust outlets; the valves being configured to vary the flow of escaping air through the exhaust outlets;

a target seeker mounted at the nose of the forward portion and configured for sensing a target and producing a target sensor signal representative of the relative location of the target;

at least one pressure sensor mounted in the pressure chamber and configured for measuring the gas pressure therein and producing a pressure sensor signal representative of changes of gas pressure in the pressure chamber; and a control unit mounted in the inner housing and operatively coupled to the controlled valves, the target seeker, and the pressure sensor, said control unit being responsive to said target sensor signal and said pressure sensor signal, and configured for controlling flight of the guided projectile by generating a valve control signal and providing said valve control signal to said plurality of separately controlled valves;

an electrical power source module operable to provide electrical power required for operating said target seeker, said at least one pressure sensor, and said plurality of separately controlled valves.

Examples of the flying apparatuses according to the present invention include, but are not limited to, projectile, missile, rocket, bomb, etc.

The steering system of the present invention has many of the advantages of the prior art techniques, while simultaneously overcoming some of the disadvantages normally associated therewith.

The steering system according to the present invention may be easily and efficiently manufactured.

The steering system according to the present invention is of durable and reliable construction.

According to another broad aspect of the present invention, there is provided a method for driving the steering system of the present invention. The method comprises:

receiving ram air by the ram air inlet;

directing said ram air through the air passage to the pressure chamber;

controllably releasing said ram air from the pressure chamber through said plurality of separately controlled valves arranged downstream of the pressure chamber by controllable operating said controlled valves, wherein said controllable operating includes:

sensing the target and producing said target sensor signal required for homing in at the target;

measuring the gas pressure the pressure chamber and producing a pressure sensor signal representative of changes of gas pressure in therein; and generating a valve control signal and providing said valve control signal to said plurality of separately controlled valves in response to said target sensor signal and said pressure sensor signal, thereby controlling flight of the guided projectile.

There has thus been outlined, rather broadly, the more important features of the invention in order that the detailed description thereof that follows hereinafter may be better understood. Additional details and advantages of the invention will be set forth in the detailed description, and in part will be appreciated from the description, or may be learned by practice of the invention.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF THE INVENTION

Figure 1:
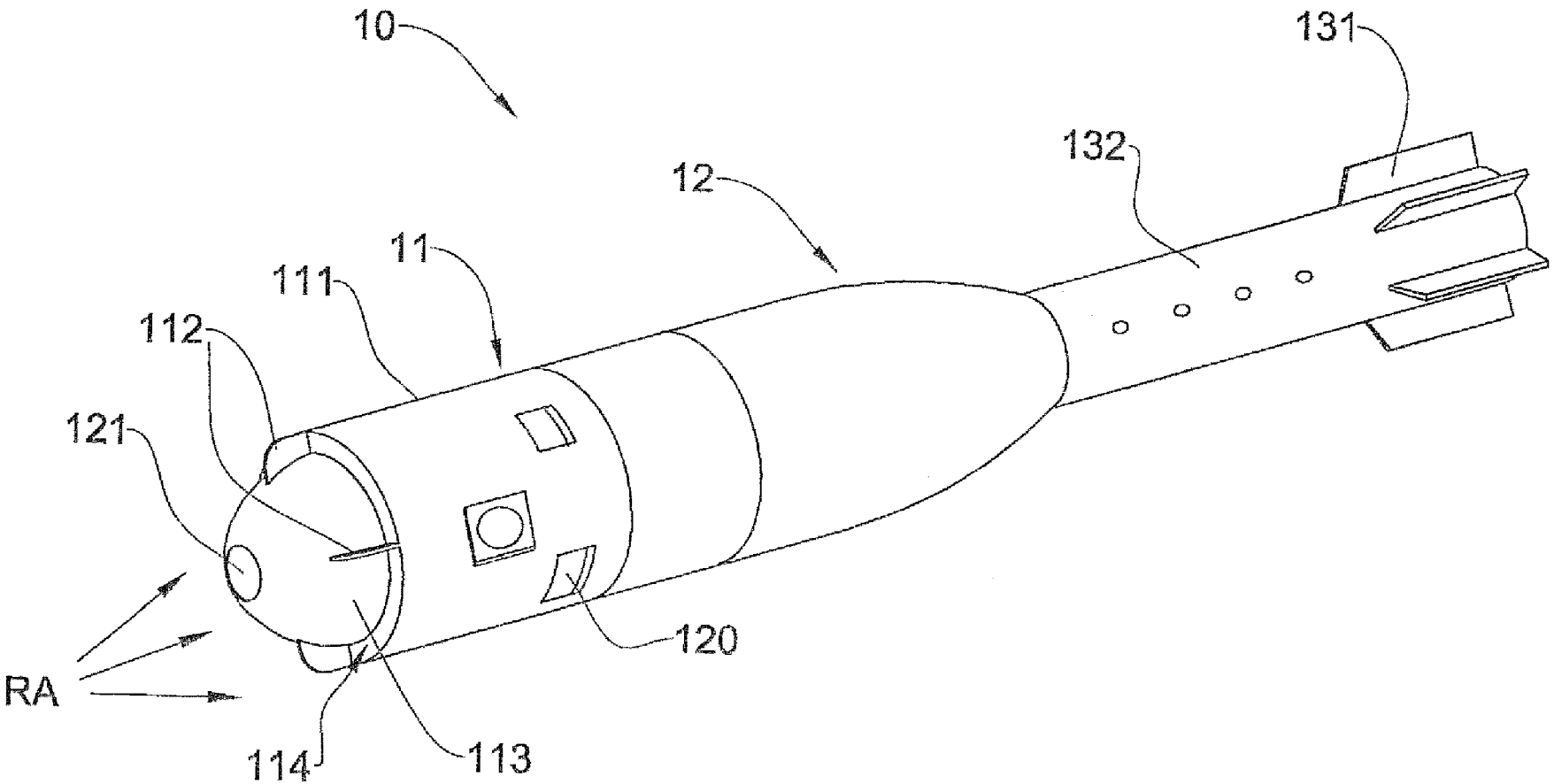
FIG. 1 is a perspective view of a guided projectile, in accordance with an embodiment of the present invention.

The principles and operation of the method and system for steering a guided flying object (e.g., projectile or missile) according to the invention may be better understood with reference to the drawings and the accompanying description, it being understood that these drawings are given for illustrative purposes only and are not meant to be limiting. The same reference numerals will be utilized for identifying those components which are common in the system and its parts shown in the drawings throughout the present description of the invention.

Figure 2:
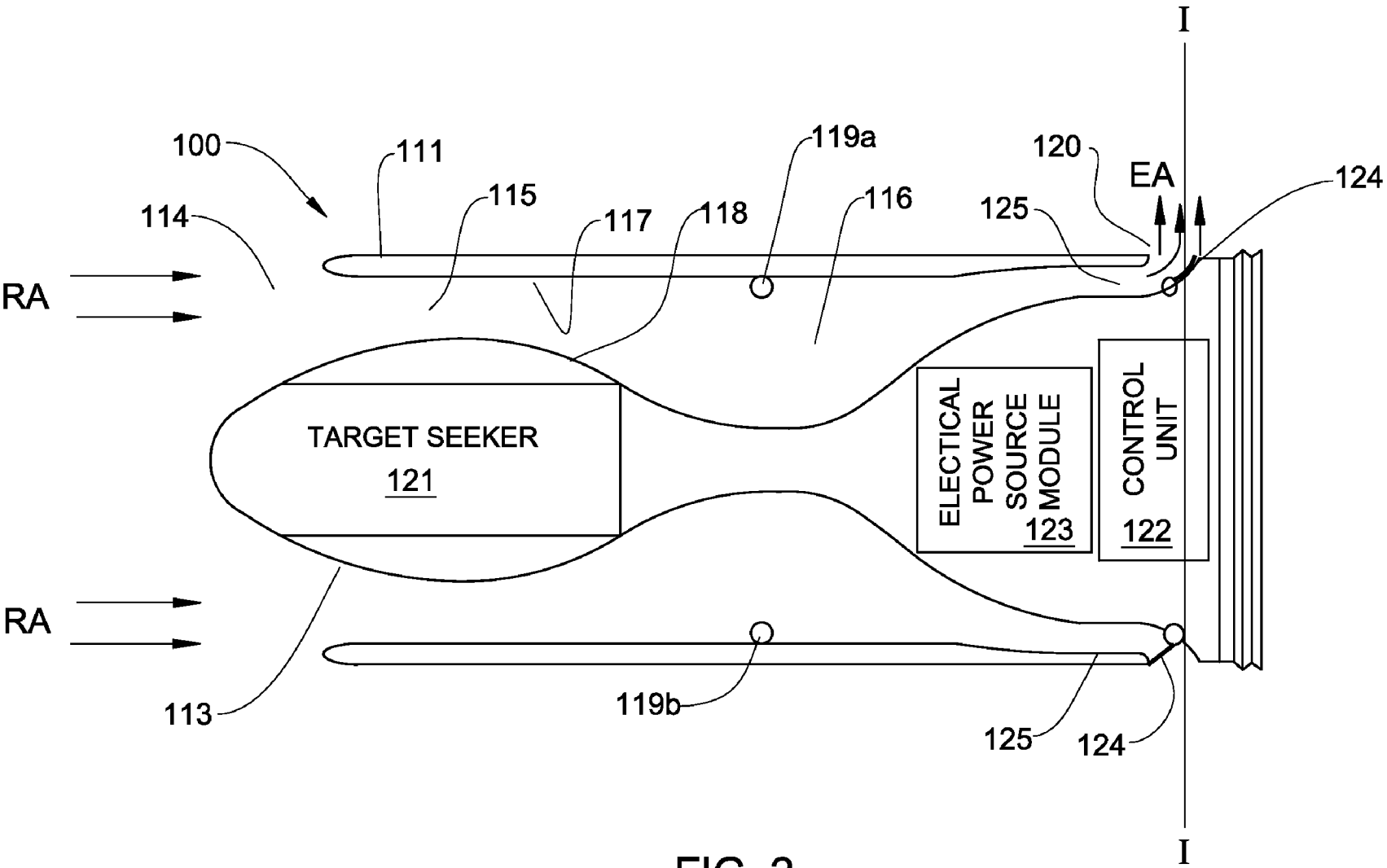
FIG. 2 is a longitudinal cross-sectional view of a forward portion of a guided projectile, according to one embodiment of the invention.

Referring to FIG. 1 and FIG. 2 together, a perspective view of a guided projectile and a longitudinal cross-sectional view of a forward portion of the guided projectile are illustrated, in accordance with an embodiment of the present invention. It should be noted that these figures as well as further figure are not to scale, and are not in proportion, for purposes of clarity.

The guided projectile 10 includes a forward portion 11 and a tail portion 12 mounted at the aft end of the forward portion 11. A steering system 100 of the projectile is arranged in the forward portion 11 and includes an outer housing 111, an inner housing 113, and a plurality of support fins 112 extending radially inwardly from the outer housing 111 and holding the inner housing 113 thereon. The outer housing 111 and the inner housing 113 define a ram air inlet 114 at a nose of the forward portion 11, an annular inlet air passage 115 downstream of the ram air inlet 114, an annular pressure chamber 116 downstream of the inlet air passage 115, and an outlet air passage 125 at the aft end of the pressure chamber 116 between an inside wall 117 of outer housing 111 and an outside wall 118 of the inner housing 113. Preferably, but not mandatory, the support fins 112 extends forwardly through the rain air inlet 114. Such a feature can partially reduce stability margin of the projectile 10, and thereby provide more sensitivity to lateral thrust steering.

The tail portion 12 includes an explosive unit (not shown) and a plurality of stabilizing fins 131 fixed circumferentially around a cylindrical body 132 of the tail portion. In the embodiment shown, 6 equally spaced fins are employed.

In operation, incoming ram air RA enters the ram air inlet 114 of the traveling guided projectile 10, flows through the inlet air passage 115, the pressure chamber 116, then passes through the outlet air passage 125 and finally through a plurality of exhaust outlets 120 arranged in the outer housing 111. Preferably, the orientation of the exhaust outlets 120 is such so that an escaping air EA could produce thrust vectors having small or negligible forward motion components. The interaction between lateral thrust, thus created, and external flow provides asymmetric aerodynamic moments utilized for guiding the projectile. In the embodiment shown, four equally spaced exhaust outlets 120 are employed.

According to one embodiment of the invention, the inner housing 113 houses a target seeker 121, a control unit (system) 122 and an electrical power source module 123. The electrical power source module 123 can, for example, include a battery or an electric generator activated from the ram air for providing electrical power to the units of the projectile 10. It should be understood that electrical power source module 123 can also be mounted in any place within the forward portion 11 of the guided projectile 10.

The target seeker 121 is mounted at a nose of the projectile 10, and is configured for sensing a target (not shown) and producing a target sensor signal required for homing in at the target. For example, the signal can be representative of the location of the target. The control unit 122 is electrically coupled to the target seeker 121 and responsive to the target sensor signal for steering the projectile in order to correct its trajectory when the projectile is in flight. Examples of the target seeker 121 include, but are not limited to, TV seeker, IR seeker, laser seeker and radar seeker, configured for optical or electromagnetic observation of the target.

The steering system 100 further includes a plurality of separately controlled valves 124. A number of the valves 124 corresponds to the number of the exhaust outlets 120. Each valve is mounted at the corresponding exhaust outlet 120. The valves 124 are electrically coupled to the control unit 122 and controllable in such a manner that they are able to vary the flow of the escaping air through the exhaust outlets 120, and thus control the trajectory of the projectile. An example of the valve 124 includes, but is not limited to, a solenoid activation valve, known per se.

In operation, when no steering correction is required, the valves 124 are normally held in a position which closes the exhaust outlets 120. As the projectile is in flight within atmosphere, a positive gauge ram air pressure (with respect to the atmospheric pressure) is present in the pressure chamber 116. The valves 124, when energized, open the exhaust outlets 120, thereby allowing the air to escape therefrom.

Figure 3:
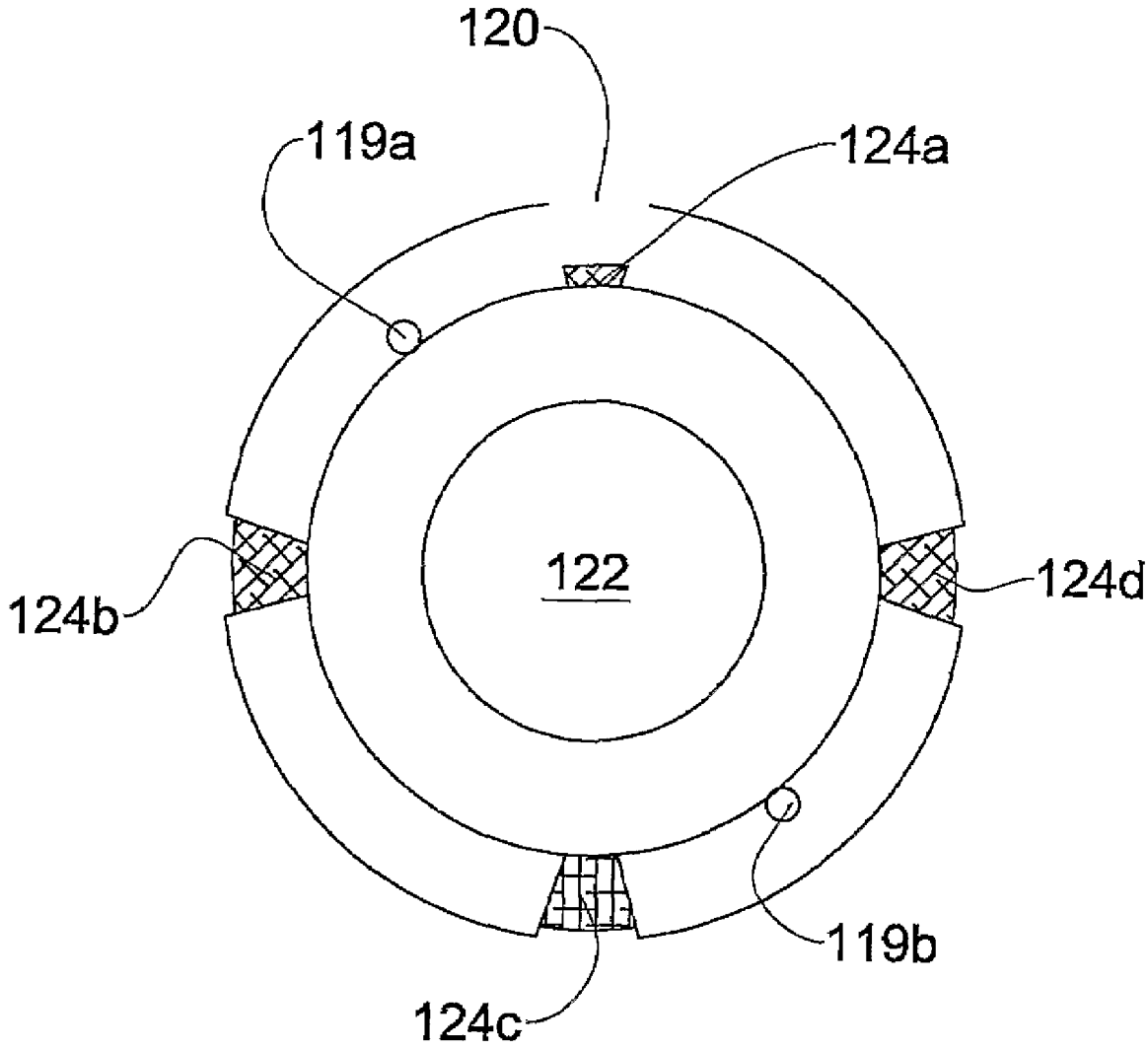
FIG. 3 is a cross-sectional view of the forward portion shown in FIG. 2 taken along line I-I.

Referring to FIGS. 2 and 3 together, the steering system 100 further comprises one or more pressure sensors mounted in the pressure chamber 116 and configured for measuring the gas pressure in the pressure chamber 116. Preferably, the measuring of the gas pressure is carried out by utilizing a pressure sensor in cooperation with one or more controllable valves distant therefrom.

For example, two pressure sensors 119*a* and 119*b* can be employed in the system with four controllable valves 124*a*-124*d*, as shown in FIG. 3. According to this example, when the controllable valves 124*a* and/or 124*b* operate, the measurement data of the pressure sensor 119*b* located between the opposite controllable valves 124*c* and/or 124*d* can be used, and vice versa, the controllable valves 124*c* and/or 124*d* can operate in cooperation with the pressure sensor 119*a*. This feature may provide more adaptive thrust control.

The pressure sensor(s) are configured for generating a pressure sensor signal representative of changes of gas pressure in the pressure chamber 116. The control unit 122 is electrically coupled to the pressure sensor(s) and responsive to the pressure sensor signal.

On the basis of the target sensor signal and the pressure sensor signal, the controller is able to generate a valve control signal, thereby to regulate the operation of the valves 124.

According to one embodiment, the valves 124 can operate in a sequential manner. In this case, only one valve is open at a certain time interval, while all other valves remain closed at this time interval. When required, the valves can operate in either a continuous regime or a pulse regime. In the continuous regime a valve is continuously open over the certain time interval, while in the pulse regime the valve opens and closes many times over this time interval.

According to another embodiment, the valves 124 can operate also in a parallel manner, i.e., when two ore more valves can be open simultaneously.

As such, those skilled in the art to which the present invention pertains, can appreciate that while the present invention has been described in terms of preferred embodiments, the concept upon which this disclosure is based may readily be utilized as a basis for the designing of other devices and processes for carrying out the several purposes of the present invention.

Although the system and method for the steering of a traveling guided projectile have been described hereabove in the detail description section, it should be understood that these method and system can be used for the steering of a missile, rocket, bomb and/or any other similar flying apparatus, mutatis mutandis.

Also, it is to be understood that the phraseology and terminology employed herein are for the purpose of description and should not be regarded as limiting.

It is important, therefore, that the scope of the invention is not construed as being limited by the illustrative embodiments set forth herein. Other variations are possible within the scope of the present invention as defined in the appended claims and their equivalents.

The invention claimed is:

1. A steering system for use in a traveling guided flying apparatus, the system comprising:

an outer housing and an inner housing defining: a ram air inlet at a nose of the forward portion, an annular inlet air passage, an annular pressure chamber, and outlet air passage between an inside wall of the outer housing and an outside wall of the inner housing;

a plurality of support fins extending radially inwardly from the outer housing and holding the inner housing thereon;

a plurality of exhaust outlets arranged in the outer housing;

a plurality of separately controlled valves mounted at the exhaust outlets;

the valves being configured to vary the flow of escaping air through the exhaust outlets;

a target seeker mounted at the nose of the forward portion and configured for sensing a target and producing a target sensor signal representative of the relative location of the target;

at least one pressure sensor mounted in the pressure chamber and configured for measuring the gas pressure therein and producing a pressure sensor signal representative of changes of gas pressure in the pressure chamber;

a control unit mounted within the flying apparatus and operatively coupled to the controlled valves, the target seeker, and the pressure sensor, said control unit being responsive to said target sensor signal and said pressure sensor signal, and configured for controlling flight of the guided projectile by generating a valve control signal and providing said valve control signal to said plurality of separately controlled valves; and an electrical power source module mounted within the flying apparatus and operable to provide electrical power required for operating said target seeker, said at least one pressure sensor, and said plurality of separately controlled valves.

2. The system of claim 1 wherein said flying apparatus is selected from the group consisting of a projectile, missile, rocket and bomb.

3. The system of claim 2 comprising:

a first controllable valve;

a second controllable valve;

a third controllable valve;

a fourth controllable valve;

a first pressure sensor arranged between said first controllable valve and said second controllable valve; and a second pressure sensor arranged between said third controllable valve and said fourth controllable valve;

wherein said first pressure sensor operates in cooperation with any one of the third and said fourth controllable valves; and said second pressure sensor operates in cooperation with any one of the first and said second controllable valves.

4. The system of claim 1 wherein orientation of the exhaust outlets is such so that an escaping air could produce thrust vectors having small or negligible forward motion components.

5. The system of claim 4 comprising:

a first controllable valve;

a second controllable valve;

a third controllable valve;

a fourth controllable valve;

a first pressure sensor arranged between said first controllable valve and said second controllable valve; and a second pressure sensor arranged between said third controllable valve and said fourth controllable valve;

wherein said first pressure sensor operates in cooperation with any one of the third and said fourth controllable valves; and said second pressure sensor operates in cooperation with any one of the first and said second controllable valves.

6. The system of claim 1 wherein said the support fins extends forwardly through the ram air inlet.

7. The system of claim 6 comprising:

a first controllable valve;

a second controllable valve;

a third controllable valve;

a fourth controllable valve;

a first pressure sensor arranged between said first controllable valve and said second controllable valve; and a second pressure sensor arranged between said third controllable valve and said fourth controllable valve;

wherein said first pressure sensor operates in cooperation with any one of the third and said fourth controllable valves; and said second pressure sensor operates in cooperation with any one of the first and said second controllable valves.

8. The system of claim 1 comprising:

a first controllable valve;

a second controllable valve;

a third controllable valve;

a fourth controllable valve;

a first pressure sensor arranged between said first controllable valve and said second controllable valve; and a second pressure sensor arranged between said third controllable valve and said fourth controllable valve;

wherein said first pressure sensor operates in cooperation with any one of the third and said fourth controllable valves; and said second pressure sensor operates in cooperation with any one of the first and said second controllable valves.

9. A method for driving a steering system for use in a traveling guided flying apparatus, the steering system comprising an outer housing and an inner housing defining: a ram air inlet at a nose of the forward portion, an annular inlet air passage, an annular pressure chamber, and outlet air passage between an inside wall of the outer housing and an outside wall of the inner housing; a plurality of support fins extending radially inwardly from the outer housing and holding the inner housing thereon; a plurality of exhaust outlets arranged in the outer housing; a plurality of separately controlled valves mounted at the exhaust outlets; the valves being configured to vary the flow of escaping air through the exhaust outlets; a target seeker mounted at the nose of the forward portion and configured for sensing a target and producing a target sensor signal representative of the relative location of the target; at least one pressure sensor mounted in the pressure chamber and configured for measuring the gas pressure therein and producing a pressure sensor signal representative of changes of gas pressure in the pressure chamber; a control unit mounted within the flying apparatus and operatively coupled to the controlled valves, the target seeker, and the pressure sensor, said control unit being responsive to said target sensor signal and said pressure sensor signal, and configured for controlling flight of the guided projectile by generating a valve control signal and providing said valve control signal to said plurality of separately controlled valves; and an electrical power source module mounted within the flying apparatus and operable to provide electrical power required for operating said target seeker, said at least one pressure sensor, and said plurality of separately controlled valves; a first controllable valve; a second controllable valve; a third controllable valve; a fourth controllable valve; a first pressure sensor arranged between said first controllable valve and said second controllable valve; and a second pressure sensor arranged between said third controllable valve and said fourth controllable valve; wherein said first pressure sensor operates in cooperation with any one of the third and said fourth controllable valves; and said second pressure sensor operates in cooperation with any one of the first and said second controllable valves, the method comprising:

receiving ram air by the ram air inlet;

directing said ram air through the air passage to the pressure chamber;

controllably releasing said ram air from the pressure chamber through said plurality of separately controlled valves arranged downstream of the pressure chamber by controllable operating said controlled valves, wherein said controllable operating includes:

sensing the target and producing said target sensor signal required for homing in at the target;

measuring the gas pressure in the pressure chamber and producing a pressure sensor signal representative of changes of gas pressure in therein; and generating a valve control signal and providing said valve control signal to said plurality of separately controlled valves in response to said target sensor signal and said pressure sensor signal, thereby controlling flight of the guided flying apparatus.

10. The method of claim 9 wherein said step of measuring the gas pressure includes utilizing a pressure sensor in cooperation with at least one controllable valve distant therefrom.

* * * * *